US005217833A

United States Patent [19]

Yamanaka et al.

[11] Patent Number: 5,217,833

[45] Date of Patent: Jun. 8, 1993

[54] METHOD OF PRODUCING CRT FLUORESCENT SCREEN

[75] Inventors: Takehiro Yamanaka; Susumu Saikawa; Yoshinori Yamano, all of Aichi, Japan

[73] Assignee: Sony Corporation, Japan

[21] Appl. No.: 836,731

[22] Filed: Feb. 19, 1992

[30] Foreign Application Priority Data

Feb. 23, 1991 [JP] Japan ..... 3-050616

[51] Int. Cl.[5] ..... G03C 5/00

[52] U.S. Cl. ..... 430/23; 430/24; 427/68

[58] Field of Search ..... 430/23, 24; 427/68, 427/64

[56] References Cited

U.S. PATENT DOCUMENTS 4,696,879 9/1987 Yamazaki ..... 430/23

4,859,549 8/1989 Hayashi ..... 430/23

*Primary Examiner*—Marion E. McCamish

*Assistant Examiner*—Mark A. Chapman

*Attorney, Agent, or Firm*—Ronald P. Kanenen

[57] ABSTRACT

A method of producing a fluorescent screen of a cathode-ray tube inclusive of a process to form carbon stripes by coating an inner surface of a panel with a carbon film and then drying, exposing and developing such a carbon film. The method comprises the steps of perceiving the carbon stripes on the inner surface of the panel as video information by optical means, then inputting the video information to an image processor to calculate the line widths of the carbon stripes, and controlling the exposure during the carbon stripe exposure process on the basis of the line widths thus calculated. According to this method, the line widths of the carbon stripes can be maintained constant to enhance the quality stability, and the measuring operation is remarkably simplified by a completely automated mechanical system.

1 Claim, 3 Drawing Sheets

METHOD OF PRODUCING CRT FLUORESCENT SCREEN

BACKGROUND OF THE INVENTION

1. Field of the Invention

The present invention relates to a method of producing a fluorescent screen of a cathode-ray tube (CRT) and, more particularly, to a method of forming carbon stripes or fluorescent layers on an inner surface of a CRT panel in a monochromatic or color television receiver.

2. Description of the Prior Art

It is generally customary that a fluorescent screen of a CRT panel in a color television receiver or the like is produced in the following procedure.

First the inner surface of the panel is coated with carbon and then is dried. The carbon film thus dried is exposed and developed in a manner to form carbon stripes having a predetermined width and a predetermined pitch.

Subsequently the entire inner surface of the panel is coated uniformly with a fluorescer over the carbon stripes and then is dried.

Thereafter an aperture grill with fine vertical striped slits is attached to the inner surface of the panel, which is exposed to a fluorescent light source and then is developed to produce a fluorescent screen of a first color.

Similarly to the above, second-color and third-color fluorescers are sequentially applied, dried, exposed and developed to produce a fluorescent screen of three primary colors (R, G, B).

In such carbon stripes, the line width is strictly regulated in view of contrast and so forth. Normally, panels with carbon stripes are periodically extracted by measurer on a random sampling basis, and the line widths of the carbon stripes are visually inspected by means of a microscope. The result of such measurement is fed back to an exposure table where the carbon film dried on the inner surface of the panel is exposed to a light source, so that the line width of each carbon stripe is regulated under control while changing the exposure in accordance with the measured value.

However, due to the operation of measuring the line widths of the carbon stripes by means of a microscope, it is unavoidable that some level differences are caused among individual measurers to consequently bring about variations in the line widths of the carbon stripes. Furthermore, measurements need to be performed in several portions of the panel for detecting whether the line widths are uniform or not over the entire panel, and the time required for such measurements comes to be extremely long because of the visual inspection, so that the working efficiency is rendered low. In addition, a complete result is not achievable in such periodic measurements since it is impossible to follow up any line width variations that occur during the interval of the visual inspections.

OBJECT AND SUMMARY OF THE INVENTION

It is an object of the present invention to provide a CRT fluorescent screen producing method which is capable of measuring the line widths of entire carbon stripes by a completely automated mechanical system and forming a satisfactory fluorescent screen of high quality where the line widths of the carbon stripes can be maintained constant.

For the purpose of attaining the above object, in a process to form carbon stripes by coating an inner surface of a panel with a carbon film and then drying, exposing and developing such a carbon film, the present invention is so contrived as to produce a fluorescent screen by first perceiving the carbon stripes on the inner surface of the panel as video information by optical means; then inputting the video information to an image processor to calculate the line widths of the carbon stripes; and controlling the exposure during the carbon stripe exposure process on the basis of the line widths thus calculated.

In the process of forming carbon stripes on the inner surface of a panel, the carbon stripes are perceived as video information by an optical means from the panel, and such video information is inputted to an image processor. The line widths of the carbon stripes are calculated from the video information, and the result of the measurement is fed back to exposure tables during the stripe exposure process on the basis of the line widths thus calculated, whereby the exposure is controlled to consequently form satisfactory carbon stripes of a predetermined line width.

The above and other features and advantages of the present invention will become apparent from the following description which will be given with reference to the illustrative accompanying drawings.

DESCRIPTION OF THE PREFERRED EMBODIMENT

Hereinafter an exemplary embodiment for carrying out the CRT fluorescent screen producing method of the present invention will be described in detail with reference to the accompanying drawings.

Figure 1:
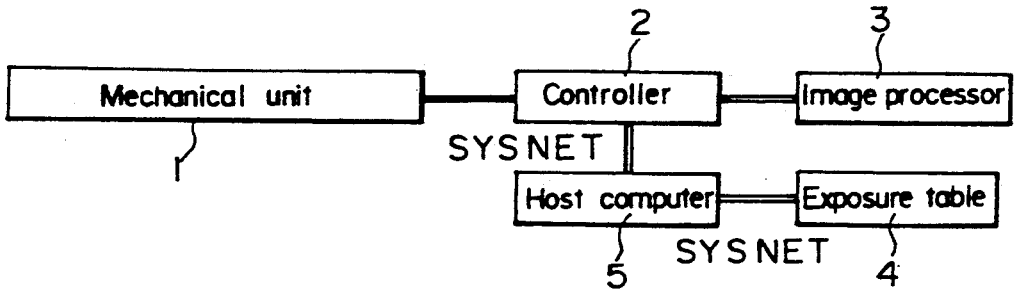
FIG. 1 is a block diagram of an exemplary automatic control system.

In this embodiment, production of a CRT fluorescent screen is executed by an automatic control system such as shown in FIG. 1. This system comprises a mechanical unit 1 with optical means for perceiving, as video information, carbon stripes formed on an inner surface of a panel; an image processor 3 for calculating the line widths of the carbon stripes in accordance with the input video information received via a controller 2; and a host computer 5 having a memory to store the data of the calculated line widths and feeding the information, which is based on such data, back to a plurality of exposure tables 4 to thereby control the exposure on the tables 4.

Figure 2:
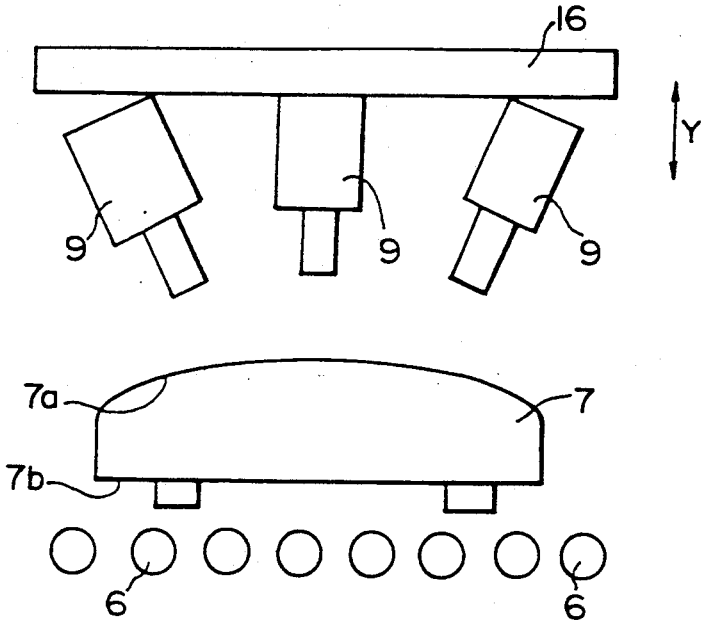
FIG. 2 is a side view illustrating the positional relationship between a panel and CCD cameras to perceive carbon stripes, which are formed on the inner surface of the panel, as video information.
Figure 3:
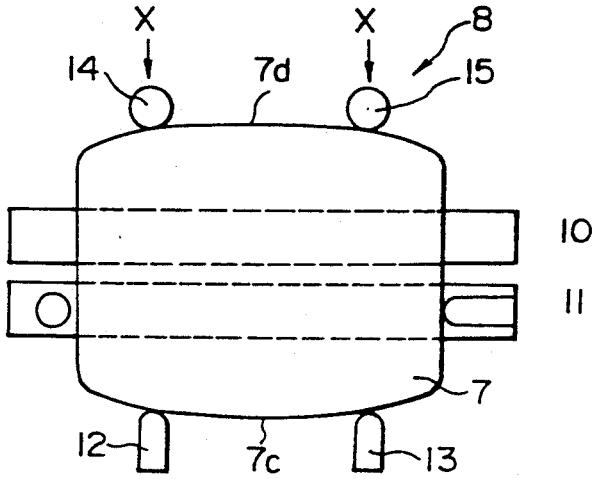
FIG. 3 is a plan view of a panel holding means.

The mechanical unit 1 comprises, as shown in FIGS. 2 and 3, a panel holding means 8 for firmly holding a panel 7, which is composed of a CRT glass plate and is transported by a plurality of rollers 6, at a predetermined position for measuring carbon stripes; and CCD cameras 9 provided as optical means to perceive the carbon stripes as video information on the inner surface 7*a* of the panel 7.

The panel holding means 8 consists of a pair of panel lift members 10, 11 for lifting up the panel 7, which is transported with its inner surface 7*a* turned downward to form a CRT fluorescent screen thereon, by a predetermined distance from the transport plane of the rollers 6; a pair of butt members 12, 13 and a pair of pressure members 14, 15 for fixedly holding the panel 7 lifted up from the transport plane of the rollers 6.

The panel lift members 10, 11 are composed of a pair of flat rectangular plates longer than the panel 7 in the longitudinal direction. The panel lift members 10, 11 are inserted between the transport plane of the rollers 6 and one surface 7*b* of the panel 7 on the open side thereof and are so driven by an unshown ascend/ descend means as to lift up the panel 7 from the transport plane of the rollers 6 by a predetermined distance.

Meanwhile the butt members 12, 13 and the pressure members 14, 15 are disposed at alignment points of the panel 7 lifted up from the transport plane of the rollers 6 and serve to hold the panel 7 fixedly. Each of the butt members 12, 13 is shaped into a square body whose portion to be in contact with one side 7*c* of the panel 7 is substantially arcuate, and is brought into point contact with the panel 7. Each of the pressure members 14, 15 disposed opposite to the butt members 12, 13 is shaped to be columnar and is resiliently urged in the direction of an arrow X in FIG. 3 toward the other side 7*d* of the panel 7 which is reverse with respect to the butt members 12, 13. Therefore the panel 7 is held fixedly while being lifted up from the transport plane of the rollers 6 by the butt members 12, 13 and the pressure members 14, 15.

Figure 7:
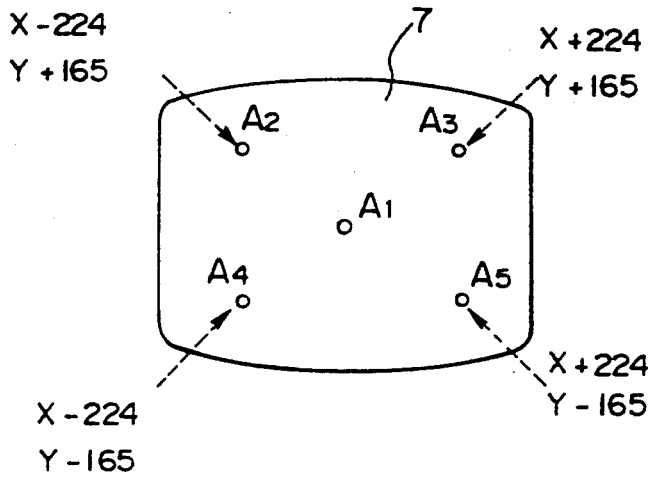
FIG. 7 is a plan view showing the positions of measurement on the panel by the CCD cameras.

The CCD cameras 9 are disposed above and opposite to the panel 7 held fixedly at a position for measuring the carbon stripes. The CCD cameras 9 are attached to a plate-shaped camera positioning base 16 and is so shifted as to advance to or recede from the panel 7 in the directions of an arrow Y in FIG. 2. Particularly in this embodiment, the CCD cameras 9 are disposed at positions corresponding respectively to the center A1 of the panel 7 and the vicinities A2, A3, A4, A5 of the four corners of the panel 7 substantially equidistant from the center Al as shown in FIG. 7, so as to be capable of detecting the distribution of the line widths of the carbon stripes on the entire panel 7. The CCD cameras 9 employed in this embodiment are monochromatic ones.

Figure 4:
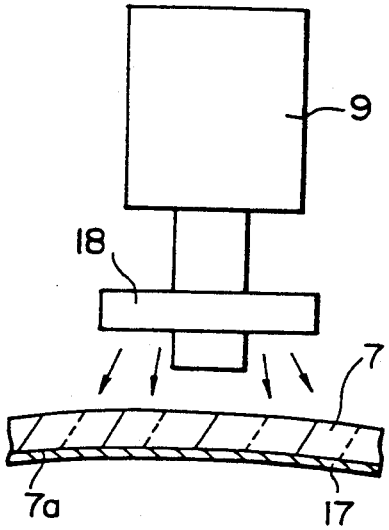
FIG. 4 is an enlarged side view illustrating how carbon stripes are perceived as video information by a CCD camera.

As illustrated in FIG. 4, a light source 18 such as a halogen lamp is provided at the fore end of each CCD camera 9 for further enhancing the distinction of the video image obtained through the optical lens relative to the carbon stripes 17 formed on the inner surface 7*a* of the panel 7. The output light emitted from the light source 18 is irradiated to a portion of the panel 7 opposite to the optical lens since the light source 18 is supported at the fore end of the CCD camera 9. The light of the halogen lamp is projected to the panel 7 via an ultraviolet cut filter.

Figure 5:
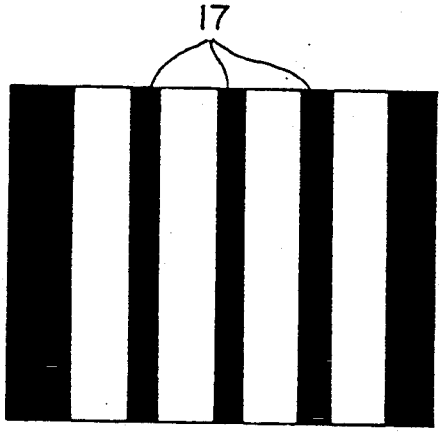
FIG. 5 shows the video information of carbon stripes.
Figure 6:
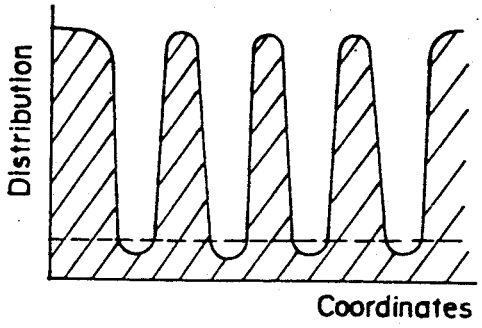
FIG. 6 is a characteristic diagram representing the information of a projected distribution obtained from the video information.

The image processor 3 is so constituted as to receive via the controller 2 the video information of the carbon stripes perceived by the CCD cameras 9 and to calculate the line widths of the carbon stripes in accordance with such video information. More specifically, the video information (such as shown in FIG. 5) obtained from the CCD cameras 9 is inputted to the image processor 3. In FIG. 5, the black portions correspond to the carbon stripes 17. And the input video information (composed of, e.g., 512×480 pixels) is converted from a voltage form into a digital signal. Subsequently the digital signal is classified into 64 gray scales, which are then added either horizontally or vertically to be replaced with information of the projected distribution shown in FIG. 6. Thereafter the noise is cut from such information, and the projected distribution above the cutting level (denoted by a dotted line in FIG. 6) is processed by a maximum differential calculus, whereby the edge portions thereof are detected. Since the information is processed and calculated on the basis of the pixels existing between the edges thus detected, the widths of the graded portions are obtained, and the line width of the carbon stripes 17 formed actually on the inner surface 7*a* of the panel 7 is measured. The line width data of the carbon stripes 17 thus calculated represents the average of the measured values of 10 stripes at the center and the four corners of the panel 7, including the data that indicate the tube kind of the panel 7 and the ID number of the relevant one of plural exposure tables 4.

Figure 8:
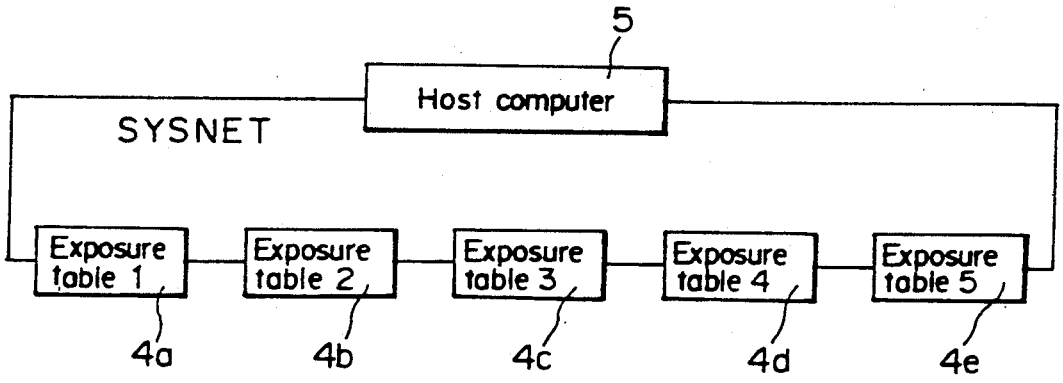
FIG. 8 shows the relationship of connection between a host computer and exposure tables.

The host computer 5 stores, in its memory, the line width data of the carbon stripes 17 calculated by the image processor 3 individually with regard to the tube kind, the ID number of the exposure table and the measurement points. Such data are fed back to the exposure tables 4 so as to control the exposure on each table 4. The host computer 5 has an exposure correcting area where the exposure is so corrected as to attain a desired line width in conformity with the preset line width of carbon stripes. For example, the exposure correcting area is divided into a region where the exposure need not be corrected if the line width of the carbon stripes has a predetermined value, and regions where the exposure is adjusted at rates of 3%, 5% and 10% respectively so as to correct the line width to the predetermined value in case any error is existent. Therefore, in the host computer 5, the operation is so performed that when the line width data of the carbon stripes 17 calculated by the image processor 3 is inputted to one region of the exposure correcting area, the exposure value predetermined in that region is automatically fed back to the exposure tables 4*a*, 4*b*, 4*c*, 4*d*, 4*e* shown in FIG. 8, whereby the exposure is adjusted in each of the tables 4*a*, 4*b*, 4*c*, 4*d*, 4*e*.

A CRT fluorescent screen is produced on the inner surface of the panel 7 in the following procedure by the use of such automatic control system mentioned above.

First, the entire inner surface 7*a* of the panel 7 transported by the rollers 6 is coated with carbon, which is then dried.

Subsequently the carbon film thus dried is exposed through a mask having a predetermined pattern with fine vertical striped slits, and then is developed to form carbon stripes 17.

Thereafter, when the panel 7 is set at a position for measuring the line widths of the carbon stripes 17, the panel 7 is lifted up by 10 mm or so from the transport plane of the rollers 6 by means of the aforementioned panel lift members 10, 11.

In such a state, the panel 7 is pressed against the butt members 12, 13 by the pressure members 14, 15.

As a result, the panel 7 is held fixedly while being lifted up from the transport plane of the rollers 6.

Subsequently the camera positioning base 16 is shifted down toward the panel 7, and the CCD cameras 9 are moved toward the panel 7.

Thereafter the output light emitted from each light source such as a halogen lamp is irradiated to the panel 7 via an ultraviolet cut filter.

The carbon stripes 17 formed on the inner surface 7*a* of the panel 7 are enlarged from a size of 1.2 mm square to a microscopic field by an optical lens and then are perceived by the CCD camera 9, whose output video information is supplied to the image processor 3.

The video information thus inputted is processed by the image processor 3, and the actual line widths of the carbon stripes 17 are calculated from such video information.

The line width data of the carbon stripes 17 are calculated individually with regard to the tube kind of the panel 7 and the ID number of the exposure table 4.

The data thus calculated are inputted to the host computer 5 and then are stored in the memory.

Thereafter the stored data are collated with the exposure correcting area in the host computer 5, and the exposure value conforming to the relevant region is automatically fed back to each of the exposure tables 4*a*, 4*b*, 4*c*, 4*d*, 4*e* in the exposure process for the carbon stripes 17.

For example, when the line width of the carbon stripes 17 formed through exposure and development on one exposure table 4*a* is not coincident with the predetermined value, the exposure of the correcting region corresponding to such value is fed back to the exposure table 4*a* so that the exposure is adjusted.

More specifically, the exposure on each of the exposure tables 4*a*, 4*b*, 4*c*, 4*d*, 4*e* is automatically controlled so that the line width of the carbon stripes 17 is maintained under control to the predetermined value. It follows that carbon stripes 17 of the predetermined line width can be formed over the entire inner surface 7*a* of the panel 7 transported by the rollers 6 after such control. It is a matter of course that, since the exposure tables 4*a*, 4*b*, 4*c*, 4*d*, 4*e* are controlled simultaneously, carbon stripes 17 of the predetermined line width can be obtained on any exposure table regardless of the ID number.

After the carbon stripes 17 have thus been formed, the entire inner surface 7*a* of the panel 7 is coated over the carbon stripes 17 uniformly with a first-color fluorescer, which is then dried.

Subsequently an aperture grill having fine vertical striped slits is attached to the inner surface 7*a* of the panel 7, which is exposed to fluorescent light of the first color from a light source and then is developed to produce a first-color fluorescent screen.

Similarly to the above, second-color and third-color fluorescers are sequentially applied, dried, exposed and developed to produce a fluorescent screen of three primary colors (R, G, B).

According to the method mentioned, it becomes possible to remarkably simplify the operation of measuring the line widths of the carbon stripes 17 by a completely automated mechanical system as well as to eliminate variations in the measurement to eventually maintain the line widths of the carbon stripes 17 constant. Furthermore, since every panel 7 can be inspected, a proper operation is continuously performed in response to any variation of the carbon stripes 17, hence ensuring accurate control of the line widths. Consequently, high stability is achievable in realizing a superior quality of the CRT fluorescent screen.

Further in the above embodiment, the line widths of the carbon stripes 17 are measured after completion of the carbon stripes 17. However, measuring the line widths of the carbon stripes 17 may be executed after forming a first-color fluorescer posterior to completion of the carbon stripes 17, or after forming a second-color fluorescer, or even after forming all fluorescers.

According to the method of the present invention, as apparent from the description given hereinabove, carbon stripes formed on an inner surface of a panel are perceived as video information by optical means, and such video information is inputted to an image processor so that the line widths of the carbon stripes are calculated on the basis of the input information. Thereafter the result of the measurement is fed back to exposure tables during the carbon stripe exposure process in conformity with the calculated line widths to thereby control the exposure. Thus, it becomes possible to continuously obtain satisfactory carbon stripes of a predetermined line width.

Furthermore, in the method of the present invention, the line widths of the carbon stripes are measured by a completely automated mechanical system. Therefore the measuring operation can be remarkably simplified with another advantage of exact measurement on every panel, hence achieving high-precision control of the line widths and enhancing the quality stability of the CRT fluorescent screen.

What is claimed is:

1. A method of producing a fluorescent screen of a cathode-ray tube inclusive of a process to form carbon stripes by coating an inner surface of a panel with a carbon film and then drying, exposing and developing such a carbon film, said method comprising the steps of:

perceiving the carbon stripes on the inner surface of said panel as video information by optical means;

inputting said video information to an image processor to calculate the line widths of said carbon stripes; and controlling the exposure during the carbon stripe exposure process on the basis of the line widths thus calculated.

* * * * *